US007791287B2

(12) United States Patent
Maschietto et al.

(10) Patent No.: US 7,791,287 B2
(45) Date of Patent: Sep. 7, 2010

(54) MULTIPLE-CELL LED ARRANGEMENT, RELATED CELL AND MANUFACTURING PROCESS

(75) Inventors: Alessandro Maschietto, Paese (IT); Giovanni Scilla, Fontane Die Villorba (IT)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 445 days.

(21) Appl. No.: 11/989,608

(22) PCT Filed: Jul. 27, 2006

(86) PCT No.: PCT/EP2006/007467

§ 371 (c)(1),
(2), (4) Date: Jan. 29, 2008

(87) PCT Pub. No.: WO2007/017140

PCT Pub. Date: Feb. 15, 2007

(65) Prior Publication Data

US 2009/0284172 A1 Nov. 19, 2009

(30) Foreign Application Priority Data

Jul. 29, 2005 (EP) ..... 05425567

(51) Int. Cl.
*H05B 37/00* (2006.01)

(52) U.S. Cl. ..... 315/291; 315/312; 315/313

(58) Field of Classification Search ..... 315/291, 315/294, 295, 312, 313, 314, 315, 323, 76, 315/363

See application file for complete search history.

(56) References Cited

U.S. PATENT DOCUMENTS

| | | | | |
|---|---|---|---|---|
| 6,194,839 | B1 | 2/2001 | Chang | |
| 6,201,353 | B1 | 3/2001 | Chang et al. | |
| 6,623,142 | B1 | 9/2003 | Lippmann et al. | |
| 2005/0040774 | A1 * | 2/2005 | Mueller et al. | 315/291 |
| 2005/0062446 | A1 | 3/2005 | Ashdown | |
| 2009/0079362 | A1 * | 3/2009 | Shteynberg et al. | 315/294 |

FOREIGN PATENT DOCUMENTS

| | | |
|---|---|---|
| DE | 101 03 611 | 8/2002 |
| WO | WO 2004/010062 | 1/2001 |
| WO | WO 01/33911 | 5/2001 |

* cited by examiner

*Primary Examiner*—David Hung Vu

(57) ABSTRACT

A LED arrangement includes:—a plurality of cells (0, 1, 2, 3) each including at least one respective LED having a binning class as a function of its emission wavelength ($L_1$, $L_2$) and brightness ($B_1$, $B_2$) characteristics, —a plurality of impedance elements (R0, R1, R2, R3) respectively coupled with the cells (0, 1, 2, 3), each impedance element (R0, R1, R2, R3) having an impedance value indicative of the binning class of the at least one LED included in the respective cell (0, 1, 2, 3), and —a controller (5) configured for sensing (6, 80, 81, 82, 83) the impedance values of the impedance elements (R0, R1, R2, R3) and adaptively drive each cell (0, 1, 2, 3) as a function of its binning class as indicated by the impedance element (R0, R1, R2, R3) coupled to the cell.

20 Claims, 1 Drawing Sheet

MULTIPLE-CELL LED ARRANGEMENT, RELATED CELL AND MANUFACTURING PROCESS

FIELD OF THE INVENTION

Figure 1:
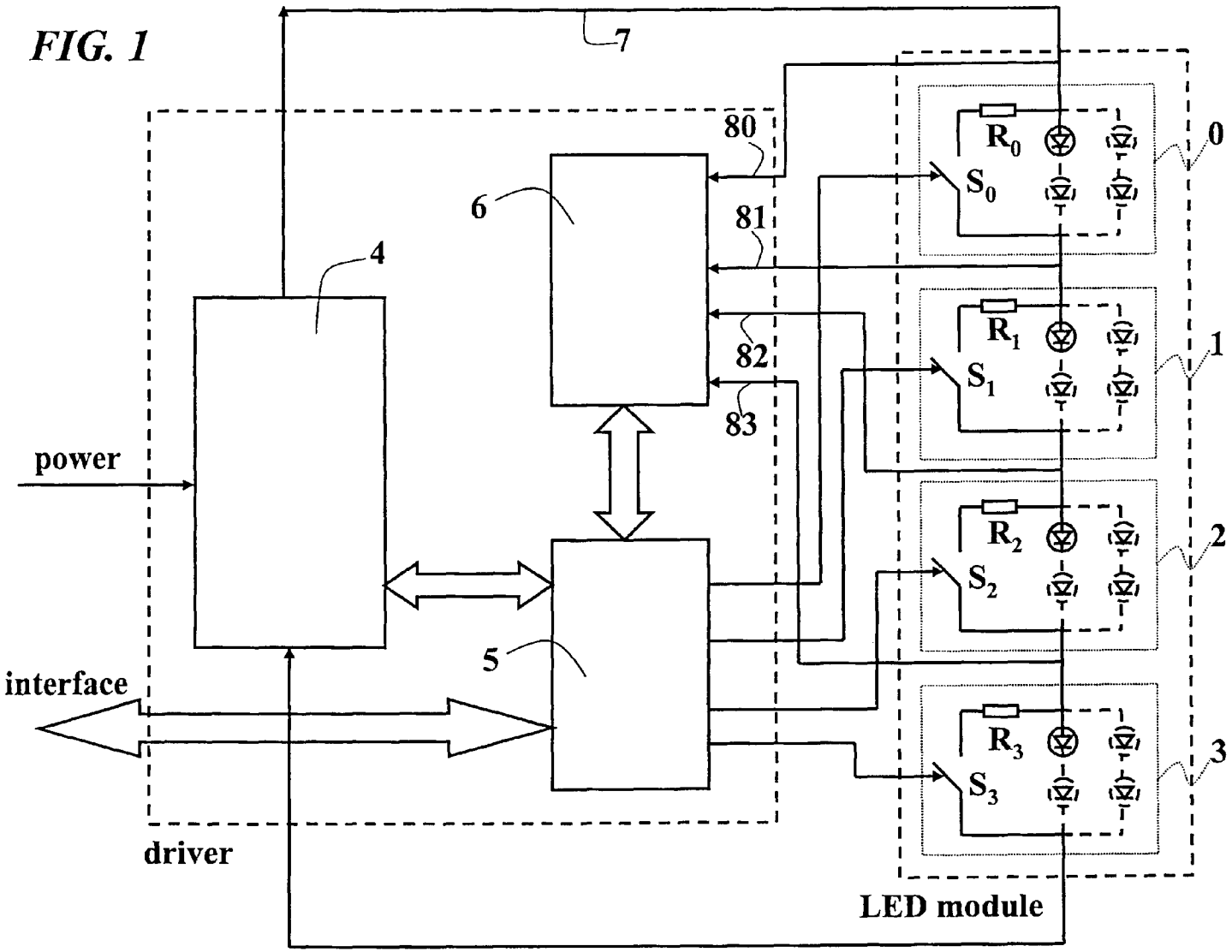

The present invention relates to arrangements for driving light emitting diodes (LEDs).

The invention has been developed with specific attention paid to its possible use in arrangements including a plurality of LED cells.

DESCRIPTION OF THE RELATED ART

In addition to the use as display units, light emitting diodes (LEDs) are becoming increasingly popular as lighting sources. This applies primarily to so-called high-flux or high-brightness LEDs. Typically, these LEDs are arranged in cells, with each cell comprised of one or more LEDs coupled in a parallel/series arrangement.

A combination of a plurality of cells each including one or more LEDs having a given emission wavelength and brightness (i.e. respective "colour") produce combined light radiation whose characteristics (spectrum, intensity, and so on) can be selectively adjusted by properly controlling the contribution of each cell. For instance, three cells each including a set of diodes emitting at the wavelength of one of the fundamental colours of three-chromatic system (e.g. RGB) produce white light and/or radiation of a selectively variable colour. Such arrangements may include i. a. so-called tunable-white systems adapted to produce white light of different "temperatures". Substantially similar arrangements may include cells each comprised of one or more LEDs of essentially the same colour and produce light sources whose intensities may be selectively adjusted to meet specific lighting requirements (for instance providing different lighting levels in different areas of a given space, a display area and so on).

Arrangements adapted for driving a plurality of such cells in association with a single constant current source are known in the art as witnessed, e.g. by WO-A-2004/100612 or DE-A-101 03 611. A substantially similar arrangement has been proposed as "Quatro-350-D" by the Dutch company eldoLED.

Essentially, in these prior art arrangements each cell has an associated switch (typically, an electronic switch) adapted to act as a selectively activatable short-circuit path to the cell. When the switch is activated (i.e. the switch is "closed") the LED or LEDs in the associated cell are short-circuited and no radiation is generated by the cell. Conversely, when the switch is de-activated (i.e. the switch is "open") the LED or LEDs in the associated cell are energized and radiation is generated by the cell. The arrangement includes a controller configured to control operation of the switches (typically according a Pulse Width Modulation—PWM control law). Such an arrangement permits to selectively and automatically adjust the contribution of each cell to the overall light flux produced. Additionally, by resorting to such an arrangement, the current power source is never completely turned off, but only driven through different path, thus ensuring a full-range dimmability of the light source.

OBJECT AND SUMMARY OF THE INVENTION

While the prior art arrangements considered in the foregoing are capable of providing satisfactory operation, they still fail to provide a solution to a number of problems that currently affect LED arrangements as discussed in the foregoing.

A first problem is related to so-called "LED binning".

Despite continuous development, present-day LED manufacturing technology is still unable to mass-produce LEDs having brightness and emission wavelength characteristics lying within a desired tolerance range. Stated otherwise, notionally identical LEDs from the same manufacturing process do in fact exhibit notable differences in terms of brightness (i.e. light power emitted for the same input electrical power) and emission wavelength (i.e. spectral characteristics of the emitted light). High-flux or high-brightness LEDs are particularly exposed to such manufacturing drifts.

In order to counter the possible negative effects of these undesired variations in the emission characteristics, LEDs are individually tested and sorted to be then delivered to users in batches, with each batch including LEDs whose emission wavelength and brightness lie within a certain range of tolerance. This process is currently referred to as "binning" (as the LEDs sorted to belong to given batch are notionally put in the same "bin")

In multiple-cell arrangement as discussed in the introductory portion of the description, the emission characteristics of the set of LEDs in each cell in the arrangement dictate the specific criteria for driving the cell: essentially, these criteria amount to defining the "on" and "off" intervals of the associated switch rewired to produce an overall light flux having the desired characteristics in terms of intensity and resulting emission spectrum.

Selecting the LEDs for use in manufacturing multi-cell by making sure that all the LEDs belong to a given binning class or category would represent a largely unpractical (and cost-ineffective) solution, This applies especially if mass production of low cost light sources is considered. Manufacturers of such sources must be capable of using the LEDs supplied to them without having to pay excessive attention to their binning classes, and possibly reject LEDs belonging to certain binning classes and/or adjust the manufacturing process (e.g. by applying different manufacturing plans or schedules in order to exploit all the different binning classes of LEDs that are supplied to them).

In addition to the basic problem outlined in the foregoing, the prior art arrangements also fail to provide a viable solution to a number of additional problems, namely:

- detecting proper operation of the switches associated with the cells in the arrangement,
- detecting proper operation of any cell in the arrangement, and
- detecting temperature/aging/power consumption of the cell.

The object of the present invention is thus to provide a fully satisfactory solution to the problems outlined in the foregoing.

According to the present invention, that object is achieved by means of a driver arrangement having the features set forth in the claims that follow. The invention also relates to a LED cell for use in such an arrangement as well as a process associated with the use of such an arrangement.

The claims are an integral part of the disclosure of the invention provided herein.

A preferred embodiment of the invention is thus an arrangement including:

- a plurality of cells each including at least one respective LED having a binning class as a function of its emission wavelength and brightness characteristics,
- a plurality of impedance elements respectively coupled with said cells, each said impedance element having an impedance value indicative of the binning class of said at least one LED included in the respective cell, and a controller configured for sensing the impedance values of said impedance elements and adaptively drive each said cell as a function of its binning class as indicated by the impedance element coupled to the cell.

A preferred embodiment of the cell of the invention is thus a LED cell including:

at least one respective LED having a binning class as a function of its emission wavelength and brightness characteristics, and an impedance element coupled with said cell, said impedance element having an impedance value indicative of the binning class of said at least one LED.

Finally, a preferred embodiment of the method of the invention is a process for manufacturing LED cells for multiple-cell LED arrangements, wherein said cells include at least one respective LED having a binning class as a function of its emission wavelength and brightness characteristics, the process including the step of respectively coupling with said cells impedance elements, each said impedance element (R0, R1, R2, R3) having an impedance value indicative of the binning class of said at least one LED included in the respective cell.

Essentially, the arrangement described herein takes full advantage of the capability (already included in prior-art driver arrangements) of selectively adapting to possible variations in the "binning" characteristics of the light sources included in each cell. Specifically, the arrangement described herein provides a simple and effective way of letting the driver controller "know" or "learn" the binning characteristics (emission wavelength and brightness) of the LED or LEDs included in each cell.

In addition to providing a fully satisfactory solution to problems related to "binning", the arrangement described herein also detects operation of any cell in the arrangement and the switch associate thereto, while also permitting to detect parameters related to LED temperature/aging/power consumption.

BRIEF DESCRIPTION OF THE ANNEXED DRAWINGS

The invention will now be described, by way of example only, with reference to the annexed FIGURE of drawing. The figure is a block diagram of LED driver arrangement as described herein.

DETAILED DESCRIPTION OF AN EXEMPLARY EMBODIMENT OF THE INVENTION

In the block diagram in the drawing FIGURE, references 0, 1, 2 and 3 designate four LED cells included in multi-cell lighting arrangement. Each of the cells 0, 1, 2 and 3 includes a set of LEDs (that is one or more LEDs) having certain light emission characteristics.

For instance, the LEDs included in the cells 0, 1 and 2 may have wavelength emission characteristics corresponding to three fundamental or primary colours of a trichromatic (i.e. three-color) system such as e.g. an RGB system. RGB is a well known acronym for Red-Green-Blue and denotes a color model based on additive color primaries. Such systems are well-established as a standard in a number of technical areas such as e.g. TV, computer display, cameras, video-cameras, camcorders, and the like. The fourth cell, designated by 3, may include one or more LEDs that either duplicate one of those primary colours (e.g. the "G" component thus producing a so-called RGBG system) or generate "white" light.

While four cells 0 to 3 are exemplified here, those of skill in the art will appreciate that the cells in question may in fact be in any number (the illustration of the possible presence of four cells in the drawing being thus of purely exemplary nature).

Each cell 0 to 3 may include either a single LED shown in full line or a plurality of LEDs, the possible presence of two or more LEDs being indicated in dashed lines. Additionally, it will be assumed (again for the sake of illustration, such a feature being in no way limiting of the scope of the invention) that the LED or LEDs included in each cell 0, 1, 2, 3 belongs to a respective, different "binning" class or category.

For instance, by assuming that such classes or categories are defined on the basis of different values of brightness and different values of (central) emission wavelength, even two cells expected to emit the same "colour" (for instance, if a RGBG system is assumed in connection with the drawing FIGURE, cells 1 and 3, both expected to emit "Green" light) may in fact belong to different binning classes as they have different brightness characteristics and/or because they exhibit different spectral characteristics (e.g. emit generally "green" light, but around central wavelengths that are appreciably spaced from each other).

For instance, assuming that "binning" is performed on the basis of two different brightness values, $B_1$ and $B_2$, and two emission wavelengths, $L_1$ and $L_2$, then four different binning classes are possible for these notionally identical cells, namely:

$B_1L_1$=class I $B_1L_2$=class II $B_2L_1$=class III $B_2L_2$=class IV

Quite obviously, what has been just described in connection with two cells expected to emit the same colour applies a fortiori to two cells expected to emit different colours and to two or more cells expected to emit "white" light Reference 4 designates a constant current source to which electrical power is fed (by known means, not shown) for feeding the LEDs of the cells 0 to 3.

Reference numeral 5 designates a controller (driven in a known manner via an interface—not shown) that, in cooperation with the current source 4 drives four switches (typically electronic switches such as MOSFETs) S0, S1, S2 and S3 each controlling energization of a respective one of the cells 0, 1, 2 and 3 in the chain. While the current source 4 provides power to the whole LED module comprised of the cells 0 to 3, the controller 5 selectively deviates (by controlling the switches S0, S1, S2, S3) the current from the LEDs e.g. according to PWM control law. Each switch S0, S1, S2 and S3 is controlled to act as a selectively activatable short-circuit path to the cell. When the switch is activated (i.e. the switch is "closed") the LED or LEDs in the associated cell are short-circuited and no radiation is generated by the cell. Conversely, when the switch is de-activated (i.e. the switch is "open") the LED or LEDs in the associated cell are energized and radiation is generated by the cell. In that way, the current source 4 is never shut off and the current generated thereby over an output line 7 is simply driven through different paths according to the on-off switching arrangements taken on by the switches S0, S1, S2, S3 under the control of the controller 5. In that way full range dimmability (0.3-100%) of the combined source is ensured.

Operation of the arrangement shown in FIG. 1—as described so far—corresponds to the prior art discussed in the introductory portion of this description, thereby making it unnecessary to provide a more detailed description herein.

References R0, R1, R2, R3 are exemplary of impedances (typically in the form of resistances i.e. resistors) coupled to each cell 0, 1, 2, 3 in such a way to provide a voltage and/or current sensing arrangement each having an associated impedance (e.g. resistance) value. This value is selectively determined in such a way to represent a sort of "label" or "signature" indicative of the binning class of the LED or LEDs included in the associated cell.

For instance, by assuming (again, this is just an example) that the LED or LEDs in the four cells 0, 1, 2, and 3 shown in the drawing belong to four different binning classes, the resistors R0, R1, R2, and R3 will have four different resistance values. Typically, such resistance values are in the range from 0 to 2.2 Ohms, so that the voltage drop across them does not affect the LED behaviour while avoiding to produce any appreciable power loss. It will be appreciated that referring to resistance value in a range having 0 Ohms as the lower bound is intended to highlight that one or more of the resistors in question may in fact have a 0 value: consequently, even if notionally shown in the drawing, these resistor in fact be merely represented by a conductor line, that is 0-Ohms resistance resistor. In any case such a zero-value "resistor" will represent a resistance (i.e. impedance) value easily distinguishable from any non-zero value: as better detailed in the following, operation of the arrangement described herein does rely on the possibility of distinguishing different values of the impedances R0, R1, R2, and R3, and not on the absolute values thereof.

In the presently preferred embodiment shown herein, the resistors R0, R1, R2, and R3 are simply connected in series with the associated switches S0, S1, S2, S3. Each resistor will thus become conductive when the associated switch S0, S1, S2, S3 is closed (thus deviating the feed current from the associated LED cell), and each resistor is de-energized when the associated switch is open (while the corresponding LED or LEDs in the associated cells are energized/activated).

References 80 to 83 designate a plurality of sensing lines coming down to an analogue-to-digital converter 6 to provide voltage sensing action across each cell 0, 1, 2, 3 (or, identically, across the associated resistor R0, R1, R2, and R3 when the respective switch is closed).

Operation of the driver (blocks 4, 5, and 6) and LED module (cells 0, 1, 2, and 3) arrangement shown in the drawing typically includes a self-adjustment phase when the arrangement is (first) activated.

In such a self-adjustment phase the controller 5 closes the switches S0, S1, S2, S3 one after the other. The voltages across each cell are transmitted via the A/D converter 6 to the controller 5. The controller 5 is thus in a position to "sense" the voltage drop across the resistors R0, R1, R2, R3.

In that way the controller 5 is in a position to "read" the value of these resistors, that as indicated represent a sort of "label" or "signature" that identifies the binning class of the LED or LEDs in the respective cell.

The controller 5 is thus in a position to "learn" the binning classes of the various cells 0 to 3 and may start its current control routine (of a known type) by adapting the driving action of the switches S0, S1, S2, and S3 (i.e. turning these switches selectively "on" and "off", according to a PWM driving law, to achieve the desired operation i.e. selective dimming, varying the colour of the overall radiation emitted, tunable-white operation and so on) to the "binning class" of each and every cell in he LED module.

For instance, one can refer again to the example made in the foregoing of two notionally identical cells possibly allotted four binning classes I to IV on the basis of two different brightness values, $B_1$ and $B_2$, and two emission wavelengths, $L_1$ and $L_2$. All the other parameters being identical, if e.g. $B_1>B_2$, then a "class I" cell or a "class II" cell (having a higher brightness value, i.e. $B_1$) will be driven "on" for shorter intervals in comparison with a "class III" cell or a "class IV" cell, respectively, as these latter cells have a lower brightness value, i.e. $B_2$.

Concurrently the controller 5 may rely on the sensing signals obtained over the lines 80 to 83, as relayed vie the A/D converter 6 to perform a number of additional sensing/detecting functions, namely:

- detecting proper operation of the switches S0, S1, S2 and S3, to detect e.g. malfunctioning due to any such switch failing to open or close as and when required,
- detecting proper operation of each LED cell (again by possibly detecting undesired open-circuit conditions when the associated switch is open, and the current expected to flow through the cell does not in fact flow through the cell, or an undesired short-circuit condition of the LED cell when the switch is closed and no current flows through the resistor as this is short-circuited through the cell), and
- measuring the voltage across each cell 0, 1, 2, and 3 thus being in a position to monitor changes in temperature (for instance, undesired overheating), aging phenomena or power consumption exceeding the design arranges.

Those of skill in the art will promptly appreciate that resistors such as resistors R0, R1, R2, R3 are exemplary of just one selection in a wide palette of possible alternatives. For instance, in the case of an ac drive of the LED module (in the place of dc drive as described herein) inductors with different inductance values may be used to "label" or "sign" the binning classes of the various LEDs in the cells. Similarly, capacitors having different capacitive values may represent another form of implementing arrangement described herein.

Practical circuit implementations of the resistors R0, R1, R2, R3 providing the impedance sensing function previously described may include resorting both discrete components and alternative arrangements such as e.g. thin-film, thick-film or IC technology.

In a particularly preferred embodiment, the resistors/impedances R0, R1, R2, and R3 (whatever the number of the resistors present may be) may be provided in the form a single resistor- (or, more generally, impedance-) generating arrangement/configuration which is subsequently "trimmed" to a well-defined impedance value when associated with the given cell or even upstream in the manufacturing process, when the cell LED or LEDs are tested for binning purposes. Exemplary of such a single impedance-generating arrangement/configuration is a strip-like resistor (e.g. a microstrip resistor) possibly provided on the same board supporting the associated cell; the length of the strip (and thus the impedance value thereof) may then be adjusted e.g. by cutting to length the strip in order to achieve a resulting impedance value that represents the desired "signature" of the binning class of the associated cell.

Finally, those of skill in the art will appreciate that wording such as "light", "lighting" and so on, are used herein according to current usage in the area of LED technology and thus encompass, in addition to visible light, electromagnetic radiation in wavelength ranges such as the ultraviolet (UV) and infrared (IR) ranges.

Of course, without prejudice to the underlying principles of the invention, the details and embodiments may vary, even significantly, with respect to what has been described in the foregoing, by way of example only, without departing from the scope of the invention as defined by the annexed claims.

The invention claimed is:

1. A multiple-cell LED arrangement comprising:

a plurality of cells (0, 1, 2, 3) each including at least one respective LED having a binning class as a function of its emission wavelength (Li, $L_2$) and brightness (Bi, $B_2$) characteristics;

a plurality of impedance elements (R0, R1, R2, R3) respectively coupled with said cells (0, 1, 2, 3), each said impedance element (R0, R1, R2, R3) having an impedance value indicative of the binning class of said at least one LED included in the respective cell (0, 1, 2, 3); and a controller (5) configured for sensing (6, 80, 81, 82, 83) the impedance values of said impedance elements (R0, R1, R2, R3) and adaptively drive each said cell (0, 1, 2, 3) as a function of its binning class as indicated by the impedance element (R0, R1, R2, R3) coupled to the cell.

2. The arrangement of claim 1, wherein said impedance elements are resistors (R0, R1, R2, R3) and said impedance value is a resistance value.

3. The arrangement of claim 1, wherein at least one of said impedance elements (R0, R1, R2, R3) has a zero impedance value.

4. The arrangement of claim 1, further comprising, coupled with each of said cells (0, 1, 2, 3), a switch (S0, S1, S2, S3) to selectively activate the impedance element (R0, R1, R2, R3) coupled to the respective cell (0, 1, 2, 3) to sense the impedance value thereof.

5. The arrangement of claim 1, further comprising:

a power source (4) to produce a current flow for energizing said cells (0, 1, 2, 3); and a switch (S0, S1, S2, S3) coupled with each said cell (0, 1, 2, 3) to selectively deviate said current flow towards and away from said at least one LED in the respective cell (0, 1, 2, 3).

6. The arrangement of claim 4, wherein said impedance element (R0, R1, R2, R3) is series connected with said switch (S0, S1, S2, S3).

7. The arrangement of claim 5, further comprising a controller (5) for selectively opening and closing said switch (S0, S1, S2, S3) coupled with each of said cells (0, 1, 2, 3) to selectively energize and de-energize each of said cells (0, 1, 2, 3).

8. The arrangement of claim 7, wherein said controller (5) is coupled with a sensor (6) for sensing the voltage across at least one of:

said respective impedance element (R0, R1, R2, R3) coupled with each said cells (0, 1, 2, 3), and said at least one LED included in said cells (0, 1, 2, 3).

9. A LED cell (0, 1, 2, 3) for a multiple-cell LED arrangement, comprising:

at least one LED having a binning class as a function of its emission wavelength (Li, $L_2$) and brightness (Bi, $B_2$) characteristics, an impedance element (R0, R1, R2, R3) coupled with said cell (0, 1, 2, 3), said impedance element (R0, R1, R2, R3) having an impedance value indicative of the binning class of said at least one LED.

10. The cell of claim 9, wherein said impedance element is a resistor (R0, R1, R2, R3), and said impedance value is a resistance value.

11. The cell of claim 9, further comprising a switch (S0, S1, S2, S3) to selectively activate said impedance element (R0, R1, R2, R3) coupled to the cell (0, 1, 2, 3) to sense the impedance value thereof.

12. The cell of claim 9, further comprising a switch (S0, S1, S2, S3) coupled with said cell (0, 1, 2, 3) to selectively deviate a current flow towards and away from said at least one LED in the cell (0, 1, 2, 3).

13. The cell of claim 11, wherein said impedance element (R0, R1, R2, R3) is series connected with said switch (S0, S1, S2, S3).

14. A process for manufacturing LED cells (0, 1, 2, 3) for multiple-cell LED arrangements, wherein said cells include at least one respective LED having a binning class as a function of its emission wavelength (Li, $L_2$) and brightness (Bi, $B_2$) characteristics, the process including the step of respectively coupling with said cells (0, 1, 2, 3) impedance elements (R0, R1, R2, R3), each said impedance element (R0, R1, R2, R3) having an impedance value indicative of the binning class of said at least one LED included in the respective, cell (0, 1, 2, 3).

15. The process of claim 14, wherein said impedance element is a resistor (R0, R1, R2, R3), and said impedance value is a resistance value.

16. The process of claim 14, further comprising the step of coupling with said cells (0, 1, 2, 3) a switch (S0, S1, S2, S3) to selectively activate said impedance element (R0, R1, R2, R3) to sense the impedance value thereof.

17. The process of claim 14, further comprising the step of coupling with said cells (0, 1, 2, 3) a switch (S0, S1, S2, S3) to selectively deviate a current flow towards and away from said at least one LED in the respective cell (0, 1, 2, 3).

18. The process of claim 16, further comprising the step of series connecting said impedance element (R0, R1, R2, R3) with said switch (S0, S1, S2, S3).

19. The process of claim 14, further comprises the steps of:

coupling with said cell (0, 1, 2, 3) an impedance-generating element, and trimming said impedance-generating element to have an impedance value indicative of the binning class of said at least one LED.

20. The process of claim 19, wherein said impedance-generating element is a strip-like impedance element, and said step of trimming includes cutting to length said strip-like impedance element.

* * * * *